340-566 SR
XR 4,009,883
SEARCH ROOM

United States Patent [19]
Yellowlees et al.
[11] 4,009,883
[45] Mar. 1, 1977

[54] BALL GAME PRACTICING DEVICE

[76] Inventors: Stuart Yellowlees, 64 Oxford St.; William Neil Dey, c/o Yellowlees, 64 Oxford St., both of Whitley Bay, Tyne & Wear, England

[22] Filed: June 13, 1975

[21] Appl. No.: 586,701

[52] U.S. Cl. ..... 273/181 C; 273/184 R; 273/DIG. 1; 340/261; 73/488; 273/102.2 S

[51] Int. Cl.[2] ..... A63B 69/36

[58] Field of Search .... 273/184, 185, 181, 176 FA, 273/102.2 S; 73/13

[56] References Cited

UNITED STATES PATENTS

| | | | |
|---|---|---|---|
| 2,102,166 | 12/1937 | Roberts | 273/181 C X |
| 2,331,236 | 10/1943 | Schaefer | 273/181 C |
| 2,557,550 | 6/1951 | Leaver et al. | 273/181 C X |
| 2,784,000 | 3/1957 | Simjian | 273/181 C |
| 3,328,033 | 6/1967 | Hendry | 273/182 R |
| 3,467,388 | 9/1969 | Weiler | 273/181 A X |
| 3,687,457 | 8/1972 | Mason et al. | 273/181 A X |

*Primary Examiner*—George J. Marlo
*Attorney, Agent, or Firm*—Watson, Cole, Grindle & Watson

[57] ABSTRACT

There is disclosed a method of practicing ball games in particular golf in which a target is positioned on the correct flight path of the ball and the sound emitted when a correctly struck ball hits the target is used as a measure of the distance which would have been travelled by the ball. An adjustable target and apparatus incorporating the target are also disclosed.

7 Claims, 4 Drawing Figures

BALL GAME PRACTICING DEVICE

BACKGROUND OF THE INVENTION

The present invention relates to a method whereby golf can be practised in a confined area and without the need for retrieval of the golf balls from a long distance after they have been hit. It also relates to apparatus for carrying out the method.

There have been a number of proposals in which the time taken for a golf ball to travel from a tee to a target is measured and the velocity of the golf ball and thus the distance it would carry are computed from this time measurement. This however involves considerable problems in measuring the moment at which the flight of the ball commences and also requires the use of somewhat complicated electrical timing equipment to compute the times involved and calculate from them the distance which the ball would have travelled. The object of the present invention is to avoid the need for the moment of commencement of the flight of the golf ball to be measured and thus to provide a simpler and more robust system. In addition with timing systems because of the high velocity of the golf ball the target has to be placed considerable distances, for example, of the order of 45 ft. from the tee and this clearly means that for such apparatus to be used, quite significant areas are required and moreover because of the possibility of deviation from an accurate trajectory the target has to be of substantial size.

SUMMARY OF THE INVENTION

The present invention utilises the noise made by the impact of the golf ball on a target to assess the velocity at which the target was struck by the ball and to provide a measure of the distance which the ball would have travelled in the absence of the target, by reference to suitable calibration.

Thus, according to the present invention a method of practising golf comprises placing a target at an appropriate standard location with respect to the tee and with regard to the club being used, striking the ball in the normal manner, the target being positioned so that if the ball follows the correct trajectory, it will strike the target and measuring, and preferably recording, the intensity of the impact, by measuring the sound emitted by the target, when the ball strikes it and either comparing the sound reading with a suitable calibration scale to determine the distance which would have been travelled by the ball in the absence of the target or supplying the output from the measuring device directly to computing means which automatically compute the distance.

DETAILED DESCRIPTION OF THE INVENTION

The calibration may be achieved by measuring, by suitable optical or electronic means, the velocity of the ball on leaving the tee for a particular sound intensity reading e.g. preferably as a direct sound intensity reading or less desirably in decibels and with a substantial number of shots preparing a suitable calibration chart or curve. The material of the target is suitably chosen to produce a satisfactory spread of sound intensity readings for shots of differing velocity.

A shot with a driver leaves the tee faster than a shot with a short iron e.g. a No. 7 iron because the driver is a longer club and thus the club head is moving faster at impact with the ball.

The target may be positioned so that it presents a limited target area appropriate for the specific club being used, and the method preferably involves adjusting the target orientation to be appropriate to the club being used. A separate calibration curve can thus be provided simply for each club in the set or if automatic computing means are used, a switch or dial setting device can be provided so that prior to hitting with a specific club e.g. a No. 5 Iron the computing device will be set for a No. 5 Iron and the target appropriately orientated for a No. 5 Iron and the mechanism will then automatically convert the sound reading to the distance which would have been achieved by a shot made with a No. 5 Iron and having that velocity (in the absence of the target).

The invention also extends to apparatus for carrying out the method. Thus according to this aspect of the invention apparatus for practising golf comprises, a baseline defined, e.g. drawn, on a board or sheet (which is preferably rigid), the base line defining a tee position and a vertical axis position for the target, these preferably being separated by from 6 to 12 or 20 feet, target supporting means, adjustably supported on the said vertical axis, the target supporting means being adjustably connected to vertical support means at a defined number of separate positions marked so that the height of the target support means is predefined for the particular club being used, the target being adjustably supported on the target support means at a number of defined angles appropriate to the particular club being used, e.g. at an angle such that a vertical plane through the target defines a line on the surface of the target which is parallel to the angle of the club head at address, the apparatus also including a microphone pick-up of sound-measuring apparatus e.g. to the rear of the target the pick-up being positioned at a predefined distance and orientation from the centre of the target and preferably at a constant position and orientation with regard to the target independent of the orientation of the target itself. The invention also extends to the adjustable target per se with the predefined heights and orientations. Alternatively, the microphone could be kept at a constant position and attenuation produced by the difference in the orientation and height of the target could be used to automatically incorporate any difference in range produced by the higher loft clubs, the starting position being with the driver so that the microphone was nearest to the target in the driver position and furthest from the target for the No. 9 Iron position of the target. Display means may be attached to the sound measuring means for displaying the reading and optionally interposed between the display means and the sound measuring means, there may be computing means for converting the sound intensity measurement into a direct reading of distance and means for setting the computing means to suit the appropriate club. Alternatively, the setting means could be directly controlled automatically by the adjustment of the target height and orientation.

The target is adjusted so that its centre is on the flight path of the ball appropriate to the club being used but the angle of the target may be adjusted to deflect the ball into a receiving area or receptacle.

The target may be flat plate of sheet material e.g. metal such as steel, or plastics such as polycarbonate or a plate of curved or non-constant cross-section either varying in thickness from the centre outwardly or from the edges inwardly, being either thicker at the centre or thicker at the edges. The target may be square or round and may be shrouded so that only the centre of the target can actually be struck by the ball. This shrouding could involve padding spaced from the front of the target or possibly attached to the front of the target to provide some sound dampening. The target is preferably orientated so as to face downwardly or sideways so as to deflect the ball after it has struck the target into a receiving bin and prevent damaging rebounds. To this end the whole target can be surrounded by suitable netting, padding or screening. The target is preferably provided with an adjustable restricted throat so as to provide a target of varying size, variable at will to require more or less precise accuracy in the striking of the ball. Alternatively the target may be of a single restricted area. The target will usually however, be at least 6 inches in diameter through the ultimate in accuracy will of course merely be an aperture sufficient to allow one ball to pass through it. As the upper limit a target of 1 foot radius might be provided but this would allow a one in six deviation when the target is 6 feet from the tee and this multiplied over say 600 feet for a 200 yard drive, would produce a deviation of 100 feet to either side which is quite an extreme degree of inaccuracy and permitting such inaccuracy probably would not be very helpful for practise. The provision however of an adjustable throat to the target allows the learner to vary at will the degree of inaccuracy he will permit himself. Alternatively the target may be provided with a much larger diameter throat and with impact recording devices e.g. mechanically or electrically operated located in sectors around the central target area effective to give an indication on an indicator board, e.g. to light up a light on a screen, to indicate which sector of the target had been hit so as to indicate whether a top or a ballooning of the ball had occurred.

The invention may be put into practice in various ways and one specific embodiment will be described by way of example with reference to the accompanying diagrammatic drawings in which.

Figures 1, 4:
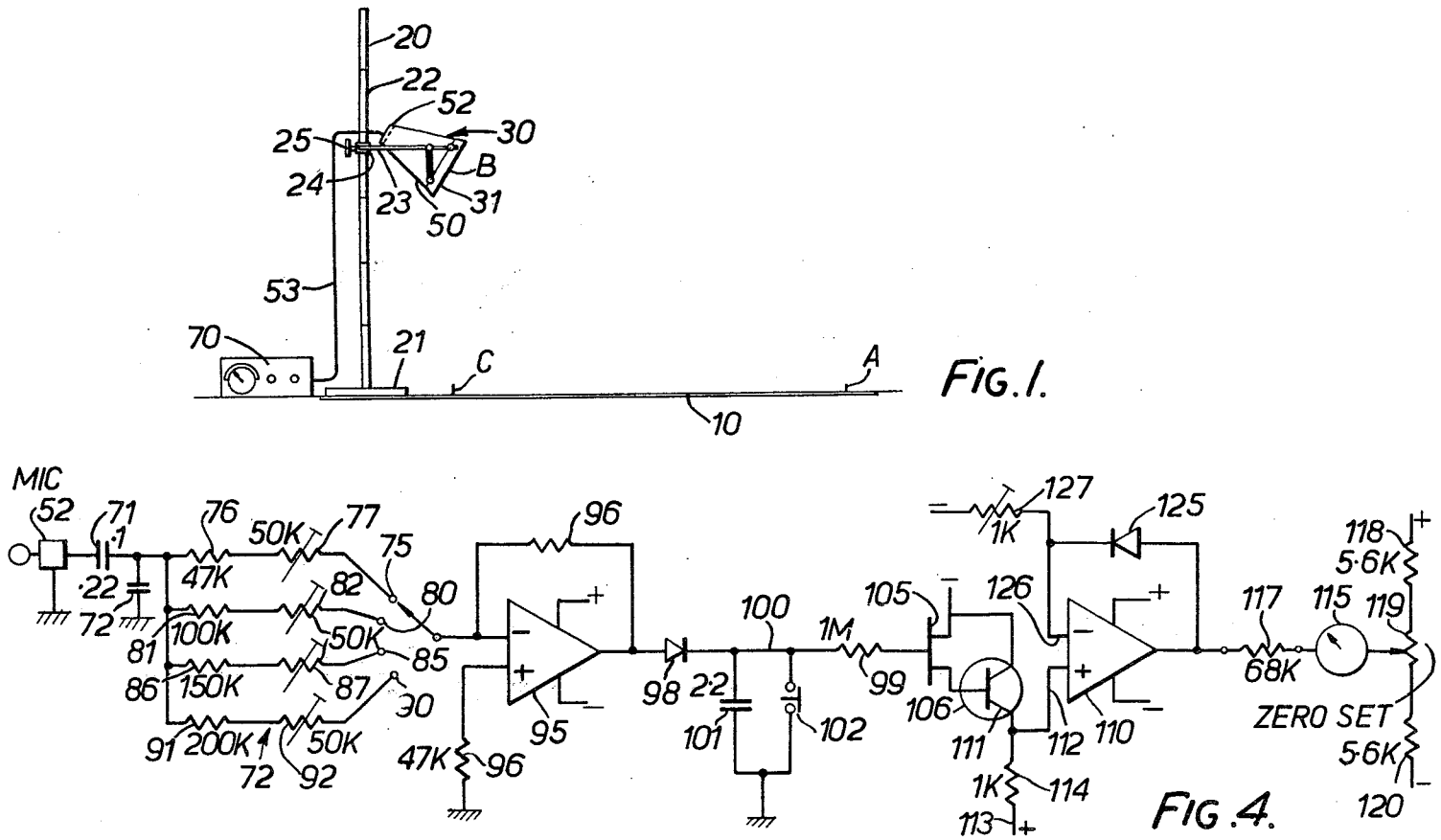
FIG. 1 is a side elevation of the device with the surrounding netting removed.
FIG. 4 is a circuit diagram of the meter used to measure the intensity of the sound picked up by the microphone.
Figure 2:
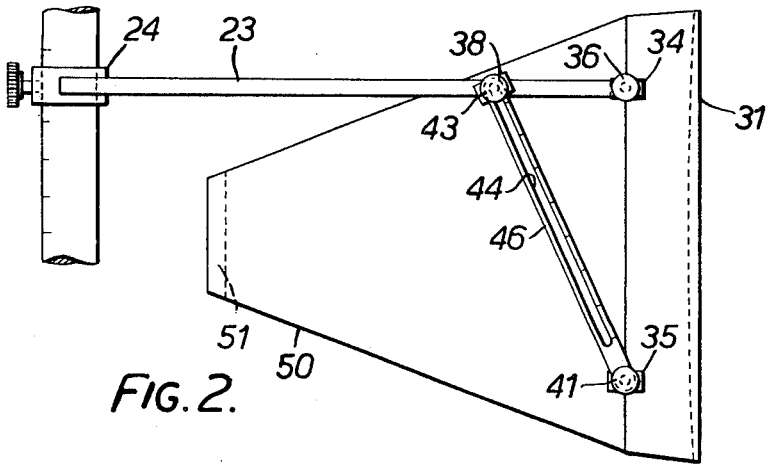
FIG. 2 is an enlarged side elevation of the target portion of the device in an inoperative horizontal orientation for clarity.
Figure 3:
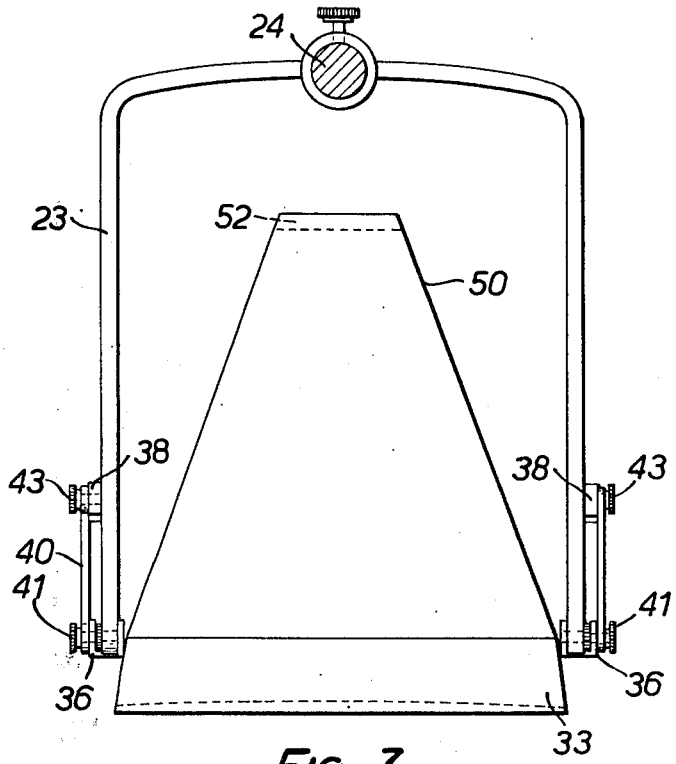
FIG. 3 is a plan view of the target on the same scale as FIG. 2.

Referring now to FIG. 1, the apparatus is optionally mounted on a rigid base board 10 which defines a tee position A and a target position C. The centre of the target is B and for each practice shot point B must be vertically above C. This can be achieved by adjusting the position of the target manually and using a plumb line. The distance between A and C is 6 feet.

The apparatus consists of a target support stand 20 having a well weighted base 21 and a 1½ inch diameter vertical supporting rod or tube 22 marked as a ruler in inches and feet or cms and additionally marked with positions for each of the clubs. A target supporting bracket 23 is slidably supported on the rod 22 by a 1½ inch internal diameter socket 24 provided with a locking unit 25. The target 30 is adjustably mounted between the arms of the bracket 23.

The target 30 comprises a target face 31 of polycarbonate sheet 12 inch square which is ¼ inch thick at the centre and thinner at the edges, e.g. ⅛ inch at the edges, the front face being flat and the rear face being curved. The assembly of sound box target face and microphone is acoustically so that equal impacts on any part of the face give the same sound reading. This is achieved by varying the thickness of the target face from the centre to the edges e.g. triming off thin layers from the rear face of the plate on a lathe. The target face is supported in an aluminium frame which forms a shallow box 33 extending 2 inches rearwardly of the target face 31.

The sides of the box 33 each carry two metal flanges 34 and 35. The upper flange 34 on each side is connected pivotally to one end of the bracket 23 by an adjustable locking nut 36. The flanges 34 and 35 are 2 inches from the top and bottom respectively of the box 33. Each arm of the bracket 23 carries a pivoted metal flange 38 4 inches from its end. A pair of slotted adjustment arms 40 are pivotally connected at their lower ends to the flanges 35 by adjustable locking nuts 41.

A pair of locking nuts 43 pass through the slots 44 in each arm 40 and into the flanges 38. The arms 40 are marked either in angles corresponding to the trajectory angle of the golf ball so that when the lower edge of the flange 38 is opposite this angle mark the face 31 will be at right angles to that trajectory from the tee point A or are marked directly for the clubs. Thus by loosening the nuts 36, 38 and 41 on each side, tilting the face 31 until the required mark on the axis 40 is opposite the flange 38 and then tightening the nuts the target can be set to the angle appropriate to the club.

On the rear face of the open box 33 there is mounted a sound box 50 of truncated pyramid shape though any other shape such as a cone could be used. The sides are 12 inches long and the top 51 of the pyramid has sides 3 inches long. A microphone pick up 52 is located in the top wall 51 and leads 53 pass down to a sound meter 70.

The sound box 50 is made of aluminum sheet. The box 50 concentrates the sound so that for a given velocity of impact the sound picked up by the microphone 52 does not vary significantly with variations in the point at which the target face is hit.

In a modification (not shown) the brackets 23 can be lockably swivelled about a horizontal axis so that after the target has been set up with the point B in the correct position the face 31 can be swivelled to one side or other so as to deflect the ball in to side netting or a collection box or bag without altering the position of point B.

The angle of elevation of the club face varies for each club and can also vary from manufacturer to manufacturer so far as identically numbered clubs are concerned. Thus whilst premarking of the tube 22 and arms 40 for actual clubs is more convenient in use it is desirable also to include actual heights and angles so that the user can if he so desires measure the angle of his clubs himself and set the target up directly.

However, the average angle of elevation for a three wood is in the order of 16°. Therefore at a distance of 6 feet from the target the centre B of the target would be positioned at approximately 1.74 feet above point C (points A and C being at the same level). For a 4 iron the elevation is 28°, and thus B − C is 3.18 feet for a 5 iron the elevation is 32°, and thus B − C is 3.72 feet and for a 7 iron the elevation is 40°, and thus B − C is 5.04 feet.

The sound meter can be of any suitable type and can be used merely to give an indication of relative sound intensity and thus relative velocities on impact and thus distance which would have been travelled, as between different shots with the same club by the same person i.e. as a practice device.

Alternatively it can be calibrated by suitable means e.g. merely by measuring and plotting the readings for a large number of shots by the same person under the same conditions, the sound readings then being averaged and compared with the average distance travelled, (this however is rather inexact since many factors come into play in determing how far the ball actually travels).

Alternative methods of calibration include dropping a golf ball from varying heights onto the target and measuring and recording the sound readings; measuring the time taken for the golf ball to go from the tee to the target e.g. electrically and comparing this with the sound reading and calculating the distance travelled from the angle of elevation of the shot, known within limits from the fact that it struck the target and the time taken to travel this initial distance.

A preferred form of sound meter is described below with reference to FIG. 4. Unlike most sound meters it does not measure sound in decibels by measuring pressure but measures the electrical output from a microphone directly.

Referring to FIG. 4 the signal from the earthed microphone 52 is taken via a 0.1 microfarad capacitor 71 to a switch handle network of resistors providing four resistor branches in parallel to provide outputs of differing gain. A 0.22 microfarad capacitor 72 is connected between earth and the junction between capacitor 71 and the resistor networks. One branch supplies output 75 via a 47K resistor 76 and a 50K variable resistor 27, another supplies output 80 via a 100K resistor 81 and a 50K variable resistor 82; another supplies output 85 via a 150K resistor 86 and a 50K variable resistor 87; and another supplies output 90 via a 200K resistor 91 and a 50K variable resistor 92.

The selected output from the resistor circuit is fed into the negative input terminal of an operational amplifier 95, which is shunted by a 220K resistor 96 and has its positive input terminal connected to earth via a 47K resistor 97, and which acts as a straight amplifier.

The output of the amplifier 95 is fed to a diode 98 which chops off the negative going signal. The output of the diode 98 is fed to a IM resistor 99 by a line 100.

A loop containing a 2.2 microfarad capacitor 101 and a switch 102 with their junctions earthed is connected across the line 100. The capacitor 101 stores the mean value of the positive signal from the amplifier 95.

A network of transistors 105 and 106 provides a high impedance input network between resistor 99 and an operational amplifier 110. The emitter electrode 111 of the transistor 106 is connected to the positive input 112 of the amplifier 110 and the junction of 111 and 112 is connected to a positive terminal 113 of the battery via a 1K resistor 114.

The transistor network 105, 106 slows down the rate of discharge of the capacitor 101 via the input 112 of the amplifier 110, which provides enough gain to drive the meter 115 via a 68K resistor 117.

A zener diode stabilization circuit is connected across the batteries to improve the zero set stability. The meter 115 has a zero set circuit consisting of three resistors 118, 119, 120 connected across the battery. The resistors 118 and 120 are 5.6K.

A diode 125 is connected across the negative terminal 126 and the output of the amplifier 110. The junction of 125 and 126 is connected to the negative terminal of the battery via 1K variable resistor 127.

Prior to each measurement one of the outputs 75 to 90 is selected, the higher the expected signal i.e. the longer the club or the stronger the shot the higher the resistance value; the switch 102 is closed to fully discharge the capacitor 101 to earth and then opened again.

The shot is played, the meter reading observed and recorded and the cycle repeated. Using this meter and by dropping golf balls onto the target face from heights varying from 1 foot to 100 feet a calibration of sound reading against velocity at impact was obtained and the velocity at impact was converted arithemtically to the distance which would have been travelled by a ball struck 6 feet from the target hitting the target with the calculated velocity at the known elevation for each particular club. This gave the following calibration using the output 75 on the circuit described above in FIG. 4.

By using the output 90 the scale can be extended to 400 units.

| | | | | | | | |
|---|---|---|---|---|---|---|---|
| Club, | No. 7. | iron, | reading | 48 | distance | 120 | yards |
| " | 6 | " | " | 58 | " | 130 | " |
| " | 5 | " | " | 67 | " | 140 | " |
| " | 4 | " | " | 74 | " | 150 | " |
| " | 3 | wood, | " | 92 | " | 180 | " |

Outputs 80 extends the scale to 200 units, and output 85 to 300 units.

A safety net of ample dimensions is provided so that in the event that the ball misses the target assembly, it will be prevented from going further. The net is mounted on a tubular arm structure connected to the target assembly. This ensures that the apertures in the safety net remains in register with the throat of the target plate.

The invention has been described with reference to the game of golf but equally it could be adapted to be used for practising other ball games e.g. to test the speed of shot of a football or a tennis ball.

Thus when reference to a golf ball is made it is to be understood that other projectiles are also included.

What we claim as our Invention and desire to secure by Letters Patent is:

1. Apparatus for practising ball games comprising: a base line, defined on a board or sheet defining a ball striking position and a vertical axis position for a target; target supporting means adjustably supported on vertical support means and the target being adjustably supported on the target support means; a microphone positioned at a predefined distance and orientation from the centre of the target, said microphone serving to receive a sound produced by a ball impacting against said target; and measuring means connected to said microphone for receiving output signals therefrom and measuring such signals and in response providing an indication of the intensity of the impact of a ball.

2. A target as claimed in claim 1, wherein said target includes a sound box and a target face forming one wall of said sound box and said microphone is located in another wall of said sound box.

3. A target as claimed in claim 2, wherein said sound box has a truncated configuration, said target face forms the base of said truncated figure and said microphone is located in the top of said turncated figure.

4. Apparatus as claimed in claim 1, wherein said measuring means includes sound measuring means coupled to the output of said microphone and display means for displaying a reading of said sound measuring means.

5. Apparatus as claimed in claim 4, wherein said sound measuring means includes resistor means supplying the signal from said microphone to an amplifier and diode so as to provide a half wave output which is stored by a capacitor, and the capacitor is allowed to discharge via a high impedance network to an operational amplifier, the output of the operational amplifier being used to drive said display means which includes a meter displaying the reading.

6. Apparatus as claimed in claim 1, wherein the target is adapted to practising golf in which the vertical support means are provided with a number of separate predefined positions indicating the club to be used so that securing the target support means at one of said predefined positions ensures that the target support means is at the corrent height for the club indicated for that position.

7. Apparatus as claimed in claim 6 in which the target is supported on said target support means by means provided with a number of predefined positions indicating the club to be used so that securing the target at one of said predefined positions ensures that the target is at the correct angle for the club indicated for that position.

* * * * *